United States Patent [19]

Cromer et al.

[11] 4,139,753

[45] Feb. 13, 1979

[54] PUFFER-TYPE COMPRESSED-GAS CIRCUIT-INTERRUPTER HAVING IMPROVED SEPARABLE CONTACT STRUCTURE

[75] Inventors: Charles F. Cromer, Levelgreen-Penn Township, Allegheny County; Kue H. Yoon, Pittsburgh; Willie B. Freeman, Monroeville, all of Pa.

[73] Assignee: Westinghouse Electric Corp., Pittsburgh, Pa.

[21] Appl. No.: 725,313

[22] Filed: Sep. 21, 1976

[51] Int. Cl.[2] ..... H01H 33/88

[52] U.S. Cl. ..... 200/148 A; 200/148 B

[58] Field of Search ..... 200/148 B, 148 A, 148 R

[56] References Cited

U.S. PATENT DOCUMENTS

| | | | |
|---|---|---|---|
| 3,158,723 | 11/1964 | Buechner | 200/148 A |
| 3,839,613 | 10/1974 | Tsubaki | 200/148 A |
| 3,852,551 | 12/1974 | Cleaveland | 200/148 A |

FOREIGN PATENT DOCUMENTS

| | | | |
|---|---|---|---|
| 2043926 | 1/1972 | Fed. Rep. of Germany | 200/148 A |
| 1580712 | 7/1969 | France | 200/148 A |
| 787846 | 12/1957 | United Kingdom | 200/144 B |

*Primary Examiner*—Robert S. Macon
*Attorney, Agent, or Firm*—W. A. Elchik

[57] ABSTRACT

An improved puffer-type, compressed-gas, circuit-interrupter is provided having an improved separable contact structure with resilient stationary contact fingers biased inwardly upon the movable tubular venting arcing contact, the latter moving with a movable operating cylinder over a relatively-fixed piston structure, and carrying an insulating nozzle therewith.

The movable tubular venting arcing contact is disposed upstream of the movable nozzle structure, and does not impede the gas flow through the nozzle structure, as generated by the relative movement of the operating cylinder over the relatively-fixed piston structure. Preferably, the relatively-stationary resilient contact fingers, are encircled by a tubular venting stationary contact support, being fixedly secured thereto, the arrangement functioning to cause contact interengagement between the stationary resilient contact fingers and the movable tubular arcing venting contact, so that upon circuit-interrupter opening movement, an arc is established between the forward tips of the resilient stationary contact fingers and the upper extremity of the movable tubular venting arcing contact. Double gas-flow occurs through both the stationary and movable tubular venting contacts, and yet the constricted portion of the insulating hollow movable nozzle may be increased only slightly by the relocation of the contact fingers to the stationary supporting portion of the interrupter. Additionally, the elimination of the usual upstream movable finger-cluster obstruction allows a corresponding reduction in the size and mass of the moving cylinder supporting spider.

8 Claims, 7 Drawing Figures

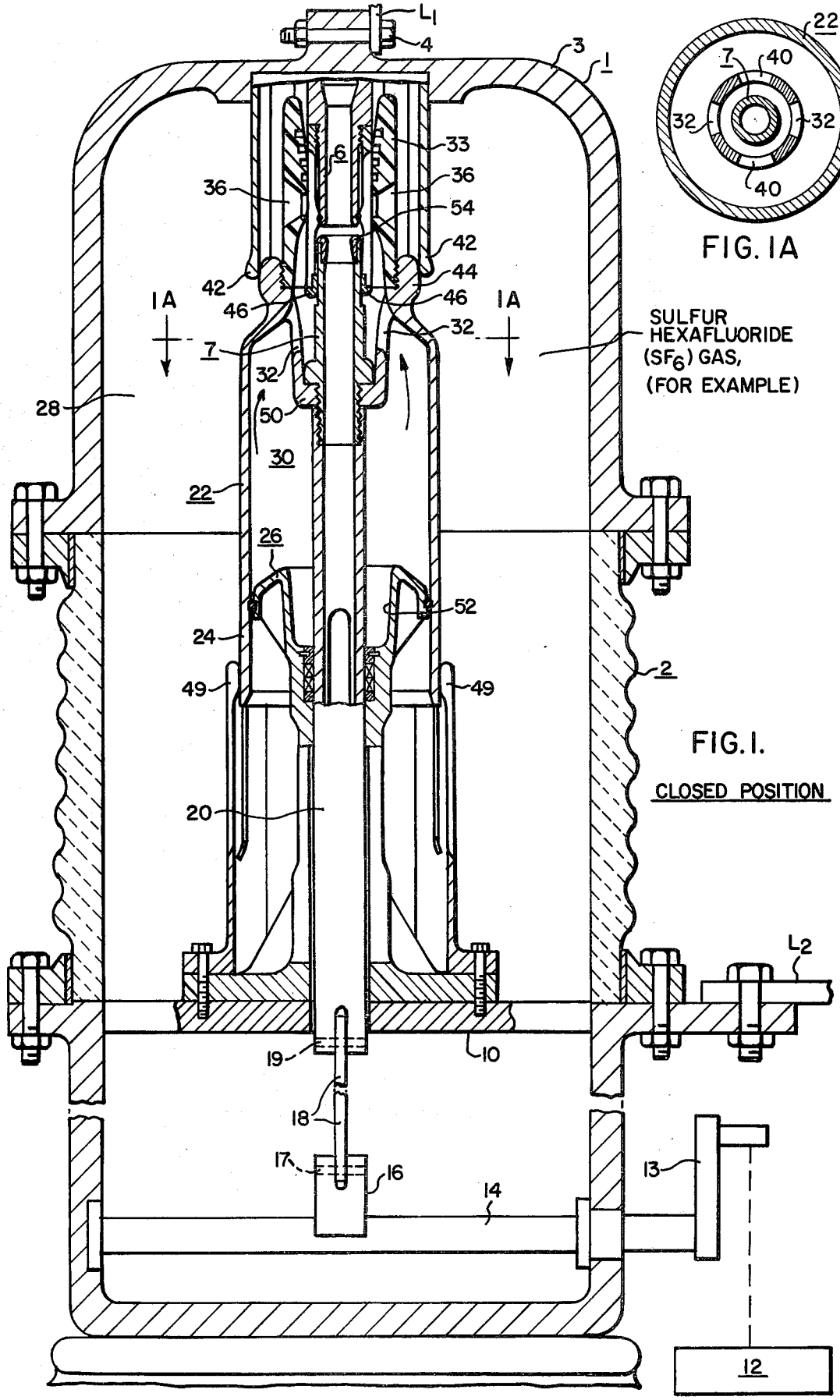
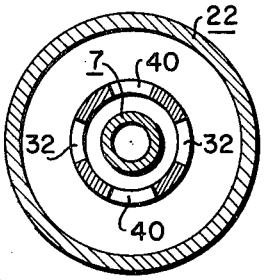
FIG. IA
FIG. I.
CLOSED POSITION

FULLY OPEN POSITION

CLOSED POSITION

FULLY OPEN POSITION

PUFFER-TYPE COMPRESSED-GAS CIRCUIT-INTERRUPTER HAVING IMPROVED SEPARABLE CONTACT STRUCTURE

CROSS-REFERENCES TO RELATED APPLICATIONS

Reference may be made to U.S. Pat. application Ser. No. 576,820, filed May 12, 1975, now U.S. Pat. No. 3,987,262, issued Oct. 19, 1976 to Joseph Rostron, entitled "Puffer-Type Gas-Blast Circuit-Interrupter Having Variable-Area Stationary Composite Piston Structure". Additionally, reference may also be made to U.S. Pat. application Ser. No. 616,703, filed Sept. 25, 1975 by Joseph Rostron et al, entitled "Improved Puffer-Type Compressed-Gas Circuit-Interrupter," and U.S. Pat. application Ser. No. 645,752, filed Dec. 31, 1975 by Charles F. Cromer et al, entitled "Improved Double-Flow Puffer-Type Single-Pressure Compressed-Gas Circuit-Interrupter," all of said patent applications being assigned to the assignee of the instant patent application.

BACKGROUND OF THE INVENTION

The present invention is particularly related to puffer-type compressed-gas circuit-interrupters of the type in which only a single pressure is utilized within the interrupting structure, and a difference of pressure for arc interruption is achieved by piston action, that is, relative movement of an operating cylinder to a piston structure. Attention may be directed to U.S. Pat. Nos. 3,839,613 — Tsubaki et al; 3,602,670 — Calvino Teijeiro; 3,849,616 — Calvino Teijeiro; 3,670,124 — Calvino Teijeiro; 3,670,125 — Calvino Teijeiro; and 3,712,969 — Calvino Teijeiro.

As well known by those skilled in the art, the relative motion between the movable operating cylinder assembly and the fixed piston structure achieves a desirable compression of gas therebetween within the compression chamber, which compressed gas is utilized during arc interruption by generally forcing the said compressed high-pressure gas through a movable nozzle structure to direct the high-pressure gas flow intimately into engagement with the established arc drawn within the movable nozzle to effect the latter's extinction.

DESCRIPTION OF THE PRIOR ART

The present invention relates to puffer-type circuit interrupters of the type set forth in U.S. Pat. No. 3,551,623, issued Dec. 29, 1970, to Robert G. Colclaser, Jr. and William H. Fischer. This patent shows the relative motion of a movable piston within a relatively stationary operating cylinder, with electromagnetic coils energizing a companion movable piston, which is electrically repelled toward the first-mentioned movable piston, the latter being attached to, and movable with, a contact-operating rod.

As well known by those skilled in the art, there are many patents treating different piston structures, for example, U.S. Pat. No. 2,429,311, issued Oct. 21, 1947, to M. J. Gay; and U.S. Pat. No. 3,786,215, issued Jan. 15, 1974 to Gerhard Mauphe.

An additional patent of interest in connection with piston structures is U.S. Pat. No. 3,331,935, issued July 18, 1967 to Stanislaw A. Milianowicz. Another piston patent, utilizing hydraulic action for effecting piston action, is U.S. Pat. No. 2,913,559, issued Nov. 17, 1959, to Charles F. Cromer.

An additional patent of interest is German Pat. No. 671,326 patented in Germany Oct. 1937. All of the aforesaid patents indicate that piston structures of the prior art are well known, but many have deficiencies of complexity and of being rather slow in operation. In addition, back-pressure gas conditions may easily arise, which renders the interrupter, as a whole, relatively slow-acting in operation, generally taking perhaps 8 cycles to effect circuit interruption.

BRIEF SUMMARY OF THE INVENTION

An improved puffer-type compressed-gas circuit-interrupter is provided having an improved stationary contact structure comprising a plurality of circumferentially-disposed, resilient, contact-fingers surrounding a stationary tubular venting contact-support, and making contacting engagement in the closed-circuit position of the circuit-interrupter with a movable tubular venting contact. The arrangement is such that the contact-finger cluster is made relatively stationary, as opposed to prior-art constructions, in which the contact-finger cluster was movable and disposed adjacent the upstream portion of the insulating movable nozzle.

In order to increase the "double" gas-flow "area" of the moving contact, it is necessary to increase the diameter of the insulating nozzle orifice, and the overall flow-areas upstream of the nozzle. However, by moving the finger-cluster of the arcing-contact structure downstream of the movable nozzle, these flow-areas upstream of the movable nozzle may be kept the same, while increasing the insulating nozzle slightly, and increasing the area of the arc-horn nozzle by 50% or more. Additionally, the present invention provides the elimination of the upstream finger-cluster obstruction, and thereby allows a corresponding reduction in the size and mass of the moving cylinder support-spider.

A further advantage of the present invention in accomplishing this increase in gas-flow area of the movable tubular venting contact is that there is a decrease in the movable mass of the separable contacts.

An ancillary feature of the present invention is the provision of a tubular contact spacer, which serves the dual purpose of pre-loading the stationary finger-cluster, and after contact separation during the opening operation, preventing the collapse and consequent damage of the stationary finger assembly. Another ancillary feature of the present invention is additionally the provision of an insulating ring surrounding the stationary tubular contact support, which prevents the welding of the stationary finger-cluster to the tubular spacer.

BRIEF DESCRIPTION OF THE DRAWINGS

FIG. 1 is a vertical sectional view taken through one embodiment of the present invention, illustrating a gas-blast puffer-type circuit-interrupter with the separable contacts being illustrated in the closed-circuit position;

FIG. 1A is a sectional view taken along the line 1A—1A of FIG. 1;

DESCRIPTION OF THE PREFERRED EMBODIMENTS

Figure 2:
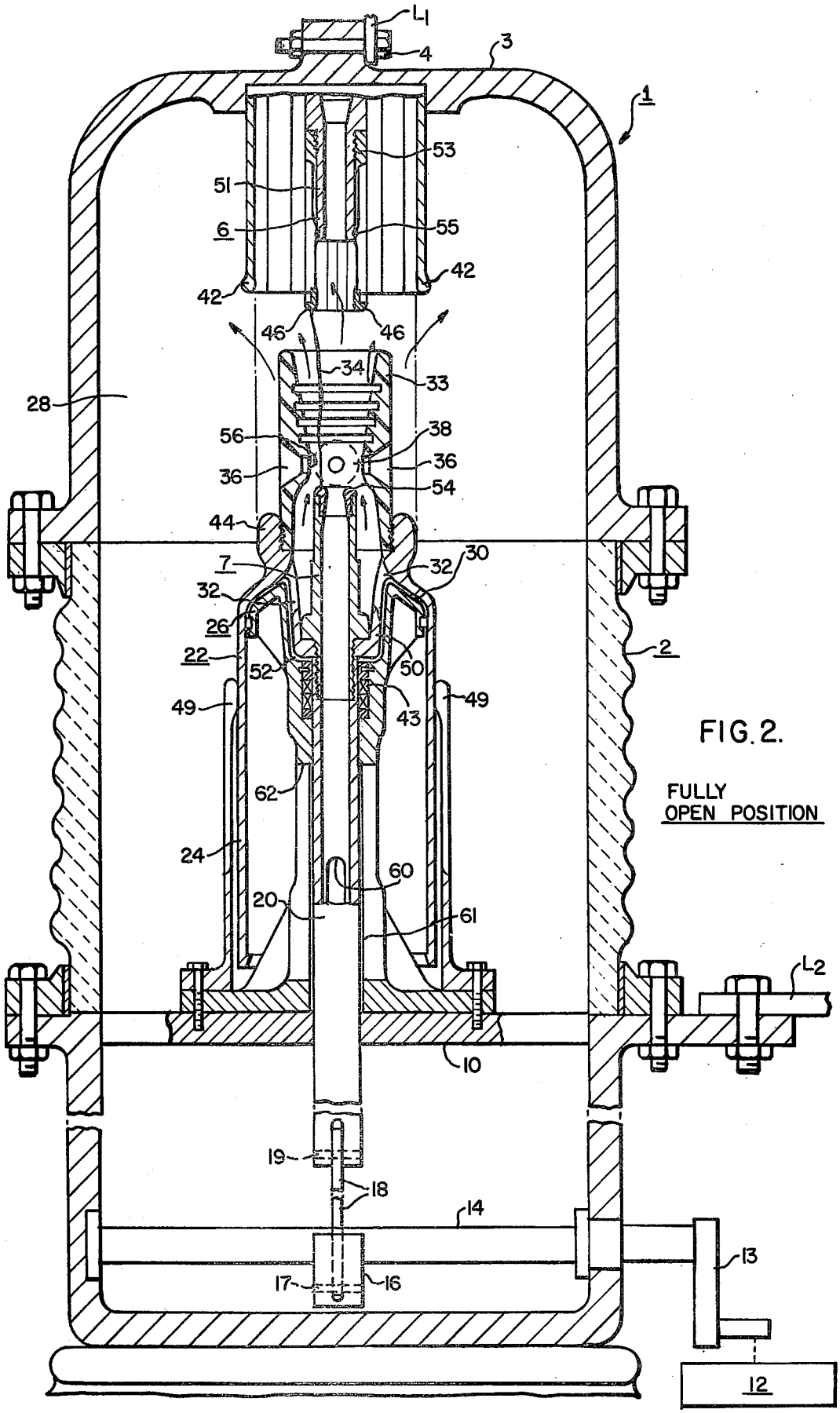
FIG. 2 is a view similar to that of FIG. 1, but illustrating the disposition of the several parts in the fully-open circuit position.

Referring to the drawings, and more particularly to FIGS. 1–4 thereof, it will be observed that there is provided a puffer-type compressed-gas circuit-interrupter 1 having an upstanding insulating casing structure 2, which is provided at its upper end with a metallic dome-shaped conducting cap portion 3, the latter supporting, by means of a bolt 4, a line-terminal connection $L_1$. Extending downwardly interiorly of the conducting dome-shaped casting 3 within the casing 2 is a relatively stationary contact structure, designated by the reference numeral 6, and cooperable in the closed-circuit position with a movable contact structure 7, as illustrated more clearly in FIG. 1 of the drawings. The movable contact structure 7 is electrically connected, by a plurality of sliding ring contacts 43, to a generally horizontally extending conducting support plate 10, which provides a second line terminal $L_2$ externally of the casing 2, as again shown more clearly in FIG. 1.

A suitable operating mechanism 12 of conventional form effects rotation of an externally-provided crank-arm 13, the latter effecting opening and closing rotative motions of an internally-disposed operating shaft 14. The operating shaft 14, in turn, is fixedly connected to an internally-disposed rotative crank-arm 16, which is pivotally connected, as at 17, to a floating link 18, the latter being pivotally connected, as at 19, to the lower end of a linearly-movable contact-operating rod 20.

It will be noted that the upper end of the contact operating rod 20 forms the movable contact 7 itself, which, as mentioned heretofore, makes contacting closed-circuit engagement with the stationary contact structure 6 in the closed-circuit position of the interrupting device 1, as illustrated in FIG. 1.

A movable operating cylinder assembly 22 is provided having a large-diameter, downwardly-extending movable sleeve portion 24, which slidably moves over a relatively-fixed piston structure 26, as again illustrated in FIG. 1.

Figure 5:
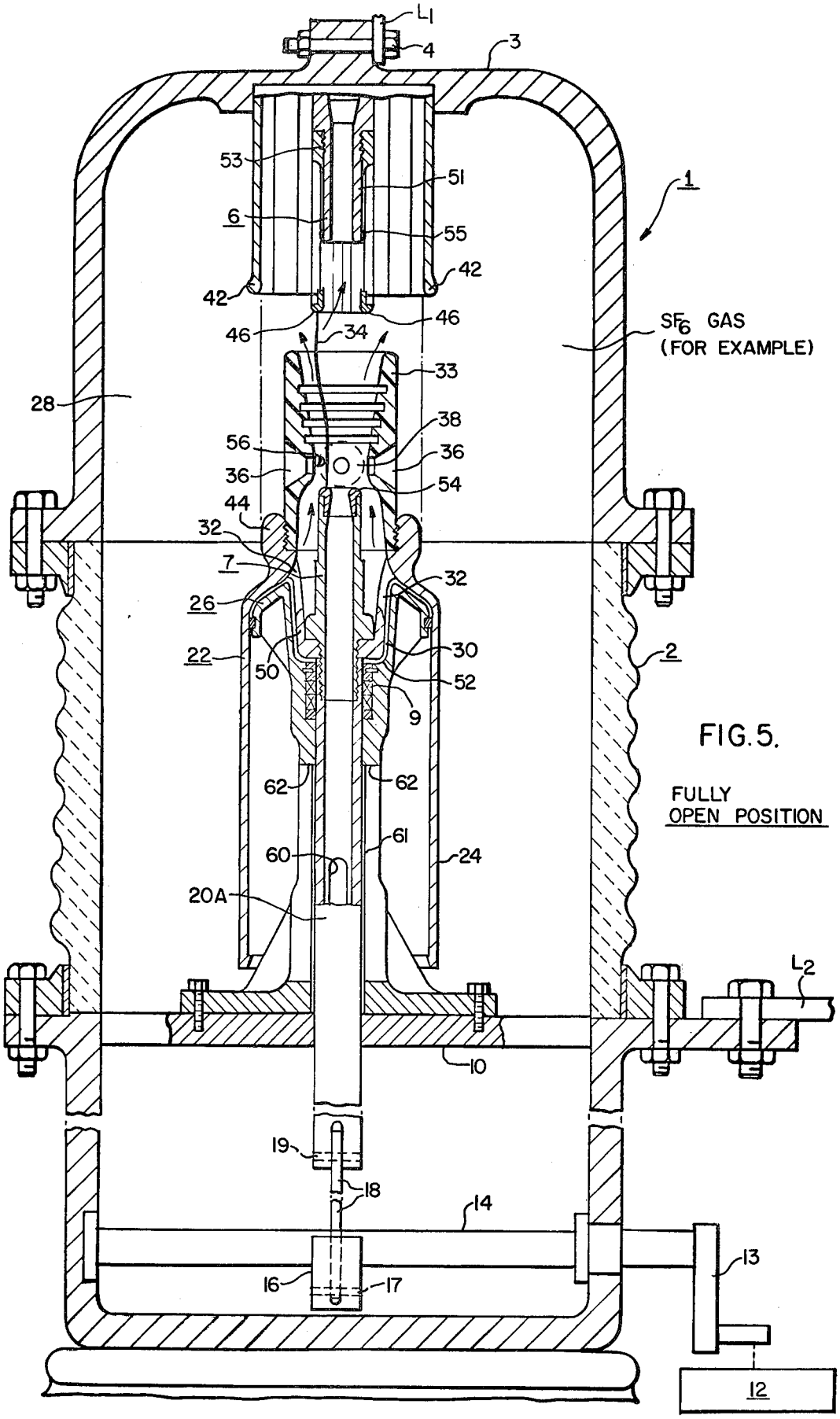
FIG. 5 is a view similar to that of FIG. 4, but illustrating the parts in the fully-open circuit position; and, FIG. 6 is an enlarged detailed view of the separable contact structure of FIGS. 4 and 5, illustrating the clamping arrangement with the figure drawn to an enlarged scale.

During the opening operation, it will be observed that the movable operating cylinder 22 moves downwardly over the relatively fixed piston structure 26 compressing gas 28 within the region 30, and forcing it to flow upwardly through the vent openings 32 and through the relatively short nozzle 33, through which the arc 34 is drawn, as shown in FIGS. 2 and 5.

With reference to the nozzle 33, it will be observed that there is provided a plurality, say in this particular instance four, vent openings 36 to enable the hot arc gases to quickly vent from the arcing region 38 to thereby enable a desirable cooling action to take place. Reference may be made to U.S. Telford Pat. No. 3,291,948 issued Dec. 13, 1966 is this connection.

FIG. 1A more clearly shows a sectional view taken through the movable operating cylinder 22, indicating the wide venting area 40 in vent openings 32 to provide unimpeded flow of high-pressure gas 28 from the compression area 30 within movable operating cylinder 22 upwardly through the vent openings 32 and into the movable nozzle structure 33, where arc-extinction quickly takes place.

The stationary main contact fingers 42 make contacting engagement in the closed-circuit position, as illustrated in FIG. 1, with an annular main movable contact portion 44. During the opening operation of the puffer interrupter 1, the main stationary contact fingers 42 part company with the annular movable main contacting portion 44, so that thereafter contact is only maintained between the stationary arcing contact fingers 46 and movable arcing contact 54, as illustrated in FIG. 1.

Downward continued opening motion of the conducting operating rod 20, as effected by operating mechanism 12, continues to force the movable operating cylinder 22 downwardly over the stationary piston structure 26, thereby providing an upward flow of compressed gas through the movable mozzle 33. It will be observed that a downwardly-extending movable boss portion 50 enters a stationary cavity 52 provided generally centrally of the relatively-fixed piston structure 26 and thereby provides a mating closing interengagement between the two structures to thereby minimize the "dead" volume of gas within space 30. This is desirable inasmuch as a higher gas-compression ratio is thereby achieved.

During the closing operation of the puffer interrupter 1, the movable operating cylinder 22 moves upwardly, and carries with it the annular main movable contact 44. First an interengagement is made between the stationary arcing contact fingers 46 and the movable tubular arcing contact 54. This contacting interengagement prevents a subsequent prestriking condition occurring between the main stationary contact fingers 42 and the main annular contact portion 44. Thus, there is no arcing occurring or permitted whatsoever at the main stationary contact fingers 42 and the annular main movable contact 44, all prestriking arcing 34 being confined to the stationary arcing finger contacts 46 and the movable arcing contact probe 54 to prevent arc erosion occurring at the main contacts.

The gas-flow path through the movable operating cylinder 22 and the movable insulating nozzle 33 presents an efficiently-shaped contour, with steadily decreasing gas-flow area reaching the minimum, or critical flow area only at the nozzle throat 56.

Figure 3:
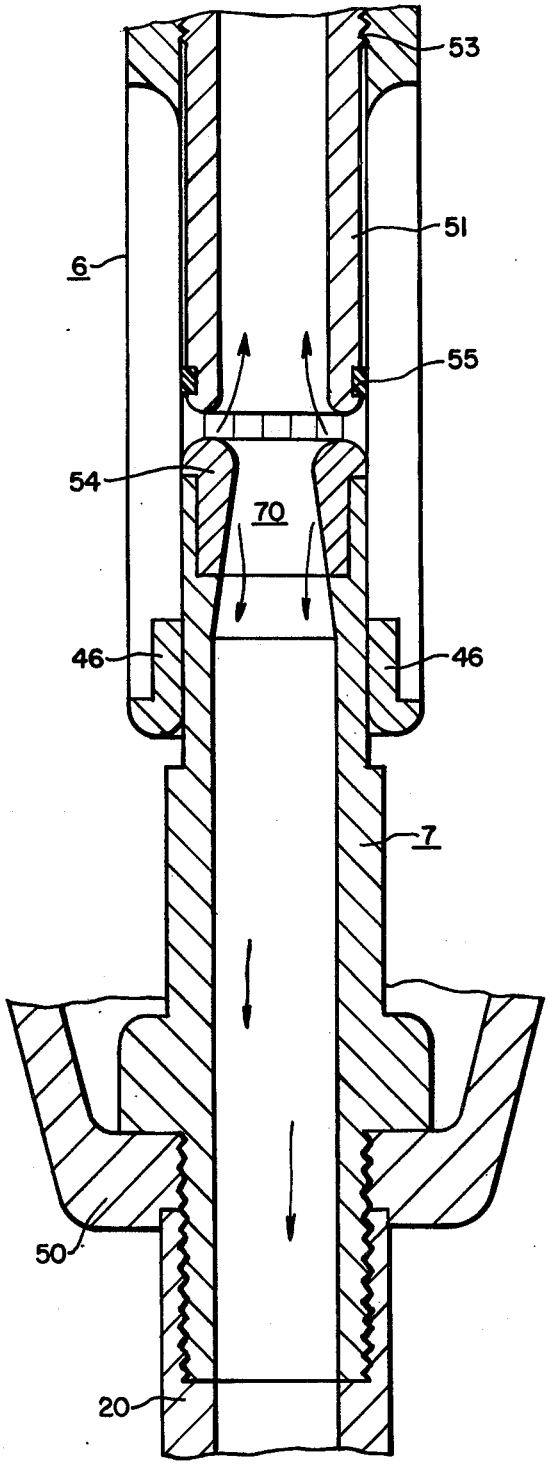
FIG. 3 is an enlarged detailed view showing the disposition of the stationary finger cluster, and its coacting engagement with the movable tubular venting arcing contact.
Figure 6:
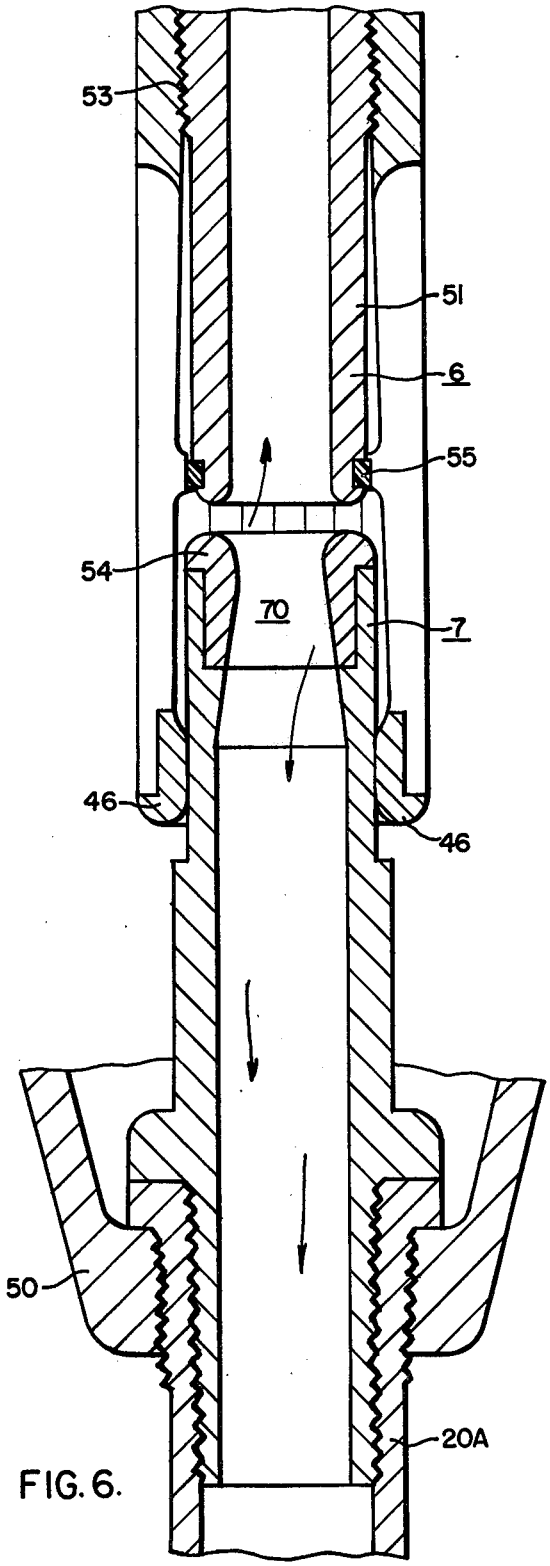

The movable arc horn 54 and the downstream stationary finger cluster 46 arrangement is shown, to an enlarged scale, in the closed-circuit position in FIG. 3.

In the closed-circuit position, the fingers 46 engage the arc horn nozzle 54 completing an electric circuit through the interrupter. The tubular stationary contact spacer 51 serves the dual purpose of pre-loading the stationary finger cluster 46 and, after contact separation on opening, prevents the collapse and consequent damage of the stationary finger assembly 46.

The insulating ring 55, illustrated in FIG. 3, prevents welding of the finger cluster 46 to the stationary spacer 51. The stationary cylindrical finger cluster 46 is shown in FIG. 3 as attached to the stationary spacer 51 by a threadable means 53 for purposes of illustration only. This stationary assembly is paralleled by, and attached electrically and mechanically to, the auxiliary main stationary finger contact assembly 42. In FIG. 1, the main closed circuit is from the stationary main finger assembly 42 through the movable cylinder wall 24 and into the stationary collector fingers 49.

Figure 4:
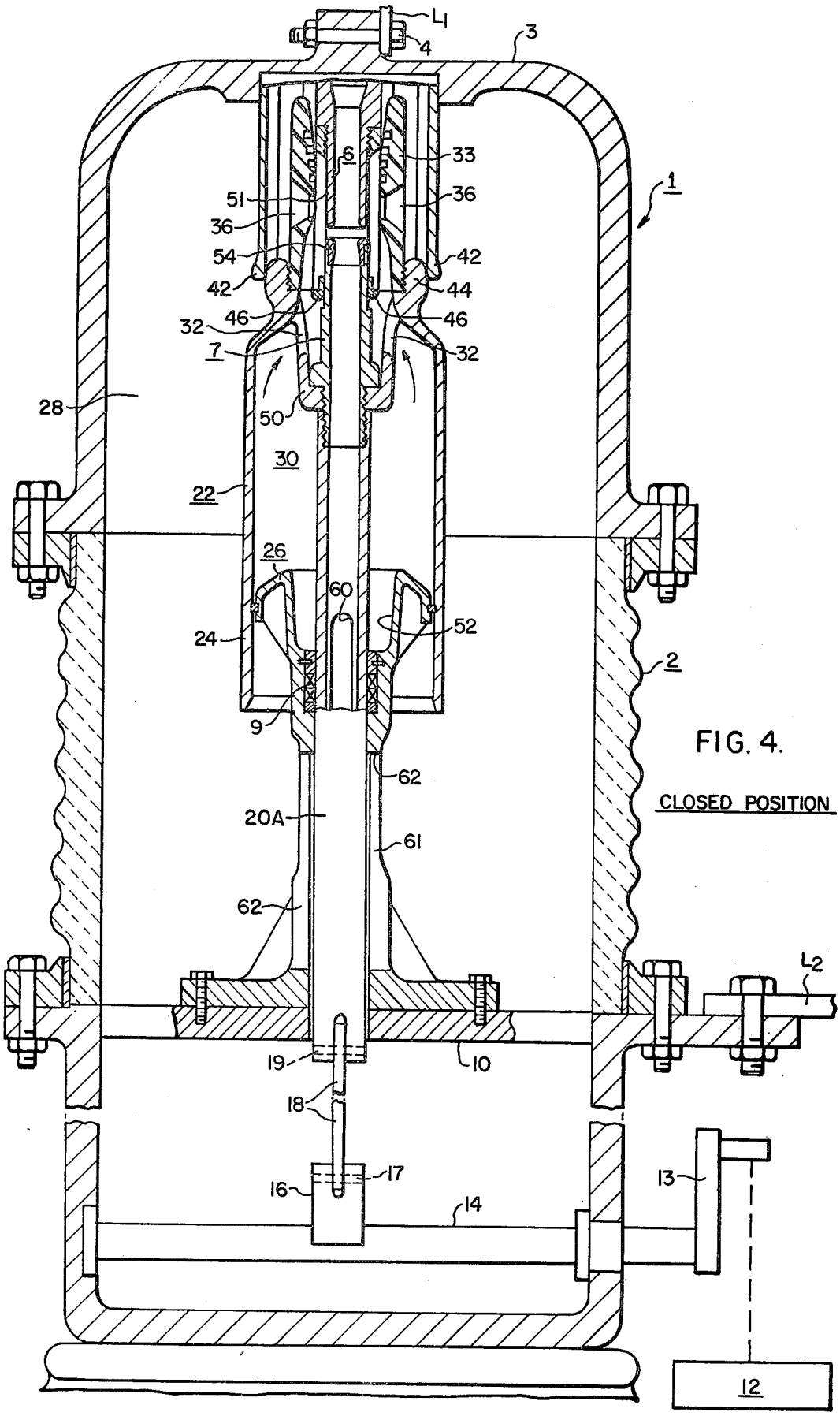
FIG. 4 illustrates a modification of the invention showing the parts in the closed-circuit position.

In the modification of FIG. 4, the closed circuit extends from the finger assembly 42, through the cylinder movable spider 50, through the movable operating rod 20 and into and through the folded metallic ribbon finger-type, current collectors 9 and thence into the conducting plate 10 to the lower line-terminal $1_2$.

As the contacts open, the auxiliary finger contacts 42 break first, and then the arc 34 is struck between the separating contacts 46 and 54; the gas in the volume 30 is compressed by the moving cylinder 22 and forced through the spider apertures 32 and in turn through the movable insulating orifice 33 and through the enlarged upstream metallic nozzle 54. The arc products and hot gasses, which are swept through the movable orifice 54, travel down the operating contact rod 20 and out the slotted openings 60 into the surrounding annular area 61 and out the piston support slots 62. FIG. 3 indicates two methods of connecting the movable arcing horn 54 and orifice discharge area 70 to the movable operating rod 20 or 20A. If stationary finger collectors 49 are used, as shown in FIG. 1, then the arrangement of FIG. 3 may be used as a clamping means only, and rod 20 may be made of steel rather than a relatively high conductivity material (for instance cupaloy), as is required for the operating rod 20A. Either clamping means may be employed with the current collectors 9, 43 as long as the operating rod 20 or 20A is of good conductivity.

Although there has been illustrated and described specific structures, it is to be clearly understood that the same were merely for the purpose of illustration, and that changes and modifications may readily be made therein by those skilled in the art, without departing from the spirit and scope of the invention.

We claim:

1. A double-flow puffer-type compressed-gas circuit-interrupter including means defining a relatively-stationary hollow venting contact structure, said relatively-stationary hollow venting contact structure including a stationary tubular metallic venting contact-support (51) and a cluster of circumferentially-disposed resilient contact-fingers (46) encircling said stationary tubular metallic venting contact-support, a relatively-movable cooperable venting contact structure comprising a movable tubular venting arcing contact, a movable operating cylinder carrying said movable tubular venting arcing contact and slidable over a relatively-fixed piston structure to compress gas in the confined space (30) therebetween, the movable tubular venting arcing contact making internal contacting engagement with said cluster of stationary resilient contact fingers in the closed-circuit position of the device, and an insulating ring (55) disposed about the extremity of the stationary tubular metallic venting contact-support (51) to prevent welding between the stationary resilient contact-fingers (46) and said tubular stationary venting metallic contact-support (51).

2. A double-flow puffer-type compressed-gas circuit-interrupter including means defining a relatively-stationary hollow venting contact structure, said relatively-stationary hollow venting contact structure including a stationary tubular metallic venting contact-support (51) and a cluster of circumferentially-disposed resilient contact-fingers (46) encircling said stationary tubular metallic venting contact-support, a relatively-movable cooperable venting contact structure comprising a movable tubular venting arcing contact, a movable operating cylinder carrying said movable tubular venting arcing contact and slidable over a relatively-fixed piston structure to compress gas in the confined space (30) therebetween, the movable tubular venting arcing contact making internal contacting engagement with said cluster of stationary resilient contact fingers in the closed-circuit position of the device, a movable tubular venting contact-operating rod (20A) being provided to effect opening motion of the movable tubular venting arcing contact, the movable tubular venting arcing contact (54) making a threaded engagement with said movable tubular venting contact-operating rod, and the movable operating cylinder (22) making threaded engagement with the outer surface of the movable tubular venting contact-operating rod (20A).

3. A double-flow puffer-type compressed-gas circuit-interrupter adaptable for high-current ratings including means defining a relatively-stationary hollow venting contact structure, said relatively-stationary hollow venting contact structure including a cluster of outer-disposed stationary main contact fingers (42) disposed in a generally cylindrical arrangement and a centrally-disposed stationary tubular venting contact support 51, means defining an internally-disposed cluster of resilient stationary arcing contact fingers (46) surrounding said stationary tubular venting contact-support (51), means defining a cooperable movable hollow venting contact structure (7), a movable operating-cylinder assembly (22) carrying said movable hollow venting contact structure (7) and also a hollow insulating movable nozzle (33), said movable operating-cylinder assembly (22) having disposed thereon adjacent its forward end an annular relatively-heavy movable main contact (44) making cooperable main contacting engagement with said cluster of stationary main contact fingers (42) in the closed-circuit position of the circuit-interrupter, means defining a relatively-fixed piston member (26), said movable operating-cylinder assembly (22) slidable over said relatively-fixed piston member (26) during the opening operation to compress gas therebetween, said movable hollow venting contact assembly (7) additionally carrying a centrally-disposed movable tubular venting arc horn (54) at its forward end which engages the stationary arcing contact fingers (46) in the closed-circuit position of the device, and gas being compressed between the movable operating cylinder and the relatively-fixed piston to be forced out of the movable cylinder assembly through said hollow insulating movable nozzle (33) and into engagement with the established arc drawn within the hollow movable insulating nozzle (33) and between the stationary arcing contact fingers (46) and the movable tubular venting arc horn (54) during the opening operation of the device.

4. The combination according to claim 3, wherein an insulating ring is disposed around the forward end of the stationary tubular venting contact-support (51) to prevent welding of the stationary arcing contact fingers 46 to said stationary tubular venting contact-support 51.

5. A double-flow puffer-type compressed-gas circuit-interrupter including means defining a relatively-stationary hollow venting contact structure, said relatively-stationary hollow venting contact structure including a stationary tubular metallic venting contact-support (51) and a cluster of circumferentially-disposed resilient contact-fingers (46) encircling said stationary tubular metallic venting contact-support, a relatively-movable cooperable venting contact structure comprising a movable tubular venting arcing contact, a movable operating cylinder carrying said movable tubular venting arcing contact and slidable over a relatively-fixed piston structure to compress gas in the confined space (30) therebetween, the movable tubular venting arcing contact making internal contacting engagement with said cluster of stationary resilient contact fingers in the closed-circuit position of the device, the movable operating cylinder (22) including a generally-truncated movable spider portion (50) having one or more gas-outlet apertures (32) provided therein for compressed-gas exhaustion from said confined space (30), and the relatively-stationary piston structure including an annular recess portion (52) into which said movable spider portion (50) of the movable operating cylinder extends in the fully-open circuit position of the device.

6. A double-flow compressed-gas type of circuit-interrupter, including a relatively-stationary cylindrically-shaped venting contact-support of limited-length (51), a cluster of considerably-longer circumferentially-disposed relatively-stationary arcing contact fingers (46) disposed about said limited-length relatively-stationary cylindrically-shaped venting contact support (51) and projecting outwardly beyond the same, a movable tubular venting arcing contact (54) making only close confronting engagement with said limited-length relatively-stationary venting contact support and being externally contactingly engaged and surrounded by said cluster of considerably-longer relatively-stationary arcing contact fingers (46), opening separating motion between the relatively-stationary arcing contact fingers (46) and said movable tubular venting contact (54) drawing an arc (34) between the projecting tips of the relatively-stationary arcing contact fingers (46) and the confronting tip-extremity of the movable tubular venting contact (54), and means for forcing a radially inwardly flow of compressed gas through the arc column and through the interior of the movable tubular contact (54) and also through said stationary contact support (51).

7. The combination according to claim 5, wherein a movable operating cylinder (22) carries said movable tubular venting arcing contact (54) and also an insulating hollow nozzle (33) and moves over a relatively-stationary piston structure (26) to compress gas therebetween during the opening operation of the circuit-interrupter, and said compressed gas being forced adjacent the tip-extremity of the movable tubular venting arcing contact (54) and also through the hollow insulating movable nozzle (33) to effect extinction of said established arc (34) by double-flow exhausting action.

8. The combination according to claim 7, wherein the movable tubular arcing contact (54) makes threaded engagement with a movable operating rod, and a plurality of circumferentially-disposed relatively-stationary main contact fingers (49) make contacting engagement with the external sides of the movable operating cylinder (22) to transfer current flow therefrom.

* * * * *